US011096421B2

(12) United States Patent
Ouyang

(10) Patent No.: US 11,096,421 B2
(45) Date of Patent: Aug. 24, 2021

(54) INSTALLATION STRUCTURE OF CONDUCTIVE CONTACT AND ELECTRONIC CIGARETTE HAVING SAME

(71) Applicant: SHENZHEN IVPS TECHNOLOGY CO., LTD., Shenzhen (CN)

(72) Inventor: Junwei Ouyang, Shenzhen (CN)

(73) Assignee: SHENZHEN IVPS TECHNOLOGY CO., LTD., Shenzhen (CN)

( * ) Notice: Subject to any disclaimer, the term of this patent is extended or adjusted under 35 U.S.C. 154(b) by 393 days.

(21) Appl. No.: 16/233,769

(22) Filed: Dec. 27, 2018

(65) Prior Publication Data

US 2020/0100541 A1 Apr. 2, 2020

(30) Foreign Application Priority Data

Sep. 30, 2018 (CN) ..... 201821615937.X

(51) Int. Cl.
*A24F 47/00* (2020.01)
*A24F 40/40* (2020.01)
*A24F 40/10* (2020.01)

(52) U.S. Cl.
CPC ..... *A24F 40/40* (2020.01); *A24F 40/10* (2020.01)

(58) Field of Classification Search
CPC ..... A24F 40/40; A24F 40/10
USPC ..... 131/329; 439/675
See application file for complete search history.

(56) References Cited

U.S. PATENT DOCUMENTS 3,416,125 A * 12/1968 Theve ..... H01R 24/52 439/638
5,067,906 A * 11/1991 Woodgate ..... F21S 8/06 439/115
5,980,266 A * 11/1999 Hsu ..... H01R 13/2421 439/37
6,155,869 A * 12/2000 Monsef ..... G01C 15/02 439/500
7,264,515 B1 * 9/2007 Rubinstein ..... H01R 13/746 211/85.2
8,314,591 B2 * 11/2012 Terry ..... A61M 11/041 320/114
9,462,831 B2 * 10/2016 Liu ..... A24F 40/40
9,642,396 B2 * 5/2017 Liu ..... A24F 40/95
9,887,478 B2 * 2/2018 Schrameyer ..... H05B 3/143
10,004,261 B2 * 6/2018 Li ..... H01M 50/213
10,218,193 B2 * 2/2019 Gratton ..... H01M 10/446

(Continued)

*Primary Examiner* — Neil Abrams
(74) *Attorney, Agent, or Firm* — IP-PAL Patent US

(57) ABSTRACT

The invention discloses an installation structure of a conductive contact of an electronic cigarette and an electronic cigarette, wherein the installation structure of the conductive contact of the electronic cigarette comprises an electronic cigarette body provided with a receiving groove and a conductive contact which is installed in the receiving groove and is exposed to an opening of the receiving groove at one end thereof. The conductive contact comprises a first contact, a second contact, an insulating part and a sealing part provided with an installation hole, and the second contact is partially received in the installation hole; the insulating part is sleeved on the second contact and is partially received in the installation hole to separate the first contact from the second contact. The sealing part comprises first and second sealing rings; the first ring may be sleeved on an upright post of the insulating part and the second ring may be sleeved on the second contact.

14 Claims, 5 Drawing Sheets

(56) References Cited

U.S. PATENT DOCUMENTS

| | | | | |
|---|---|---|---|---|
| 10,869,506 | B2 * | 12/2020 | Chen | H01R 13/2421 |
| 2018/0338534 | A1 * | 11/2018 | Jiang | A61M 11/042 |
| 2019/0000146 | A1 * | 1/2019 | Lin | A24F 40/90 |
| 2019/0223498 | A1 * | 7/2019 | Ouyang | H01M 50/572 |
| 2019/0223501 | A1 * | 7/2019 | Ouyang | H01M 10/425 |
| 2020/0100541 | A1 * | 4/2020 | Ouyang | A24F 40/40 |
| 2020/0305502 | A1 * | 10/2020 | Ouyang | A24F 47/00 |
| 2020/0352253 | A1 * | 11/2020 | Holzherr | A24F 40/90 |
| 2021/0059304 | A1 * | 3/2021 | Ouyang | A24F 40/40 |

* cited by examiner

INSTALLATION STRUCTURE OF CONDUCTIVE CONTACT AND ELECTRONIC CIGARETTE HAVING SAME

TECHNICAL FIELD

The invention relates to an installation structure of a conductive contact of an electronic cigarette and an electronic cigarette having same.

BACKGROUND

The existing electronic cigarette supplies power to an atomizing assembly in such a way that a battery assembly makes electrical contact with the atomizing assembly. Because the atomizing assembly is provided with an oil storage chamber, it is easy for tobacco tar to leak into the battery assembly under the action of gravity. However, in the existing battery assembly, the conductive contact structure in electrical contact with the atomizer is not sealed enough, so that tobacco tar easily penetrates into the battery assembly, causing corrosion of internal control elements or circuits, resulting in the phenomenon of short circuit of batteries and burning of control panels.

Therefore, the prior art still needs to be improved and enhanced.

SUMMARY

The main purpose of the invention is to provide an installation structure of a conductive contact of an electronic cigarette and an electronic cigarette, which is intended to improve the sealing performance of the conductive contact structure of the electronic cigarette and prevent tobacco tar from leaking into the battery assembly from the atomizer.

In order to achieve the above object, the technical solution adopted by the invention is as follows:

an installation structure of a conductive contact of an electronic cigarette, wherein the installation structure comprises an electronic cigarette body provided with a receiving groove and a conductive contact which is installed in the receiving groove and is exposed to an opening of the receiving groove at one end thereof, wherein the conductive contact comprises a first contact, a second contact, an insulating part and a sealing part provided with an installation hole, and the second contact is partially received in the installation hole; the insulating part is sleeved on the second contact and is partially received in the installation hole to separate the first contact from the second contact; the sealing part is partially sleeved on the insulating part and elastically abuts against the first contact, and the sealing part is partially sleeved on the second contact and elastically abuts against the insulating part.

The installation structure of the conductive contact of the electronic cigarette according to claim, wherein the insulating part comprises an upright post provided with a through hole and a chassis sleeved on the periphery of the upright post, the upright post is sleeved on the second contact and is received in the installation hole, and abuts against the inner wall of the installation hole to separate the first contact from the second contact; the chassis is fastened to the electronic cigarette body and is located between the bottom end of the receiving groove and the first contact and has gaps with the bottom end of the receiving groove and the first contact, respectively.

According to the installation structure of the conductive contact of the electronic cigarette, wherein the sealing part comprises a first sealing ring and a second sealing ring, the first sealing ring is sleeved on the upright post and is clamped between the chassis and the first contact to seal the gap between the insulating part and the first contact; and the second sealing ring is sleeved on the second contact and is clamped between the chassis and the bottom end of the receiving groove to seal the gap between the second contact and the insulating part.

According to the installation structure of the conductive contact of the electronic cigarette, wherein one end of the second sealing ring sleeved on the second contact is convexly provided with a collar in the axial direction, the collar is sleeved on the second contact and is convexly provided with a flange in the direction of the second contact, and the flange elastically abuts against the periphery of the second contact.

According to the installation structure of the conductive contact of the electronic cigarette, wherein the second contact is concavely provided with a groove adapted to the flange, and the flange is placed in the groove and is in interference fit with the groove.

According to the installation structure of the conductive contact of the electronic cigarette, wherein the inner wall of the groove is provided with at least one positioning groove, the flange is provided with at least one positioning projection adapted to the positioning groove, and the positioning projection is placed in the positioning groove at a corresponding position.

According to the installation structure of the conductive contact of the electronic cigarette, wherein the second contact comprises a contact cap and a contact post provided with a step, one end of the contact cap extends out of the through hole and is exposed in the installation hole for electrical contact of an external load, and the other end thereof is received in the through hole and is sleeved on the periphery of the contact post and encloses the groove with the step; and the cooperation between the flange and the groove causes the second sealing ring to be clamped between the contact cap and the contact post.

According to the installation structure of the conductive contact of the electronic cigarette, wherein the sealing part further comprises at least one connecting post, both ends of the connecting post are vertically connected with the first sealing ring and the second sealing ring, respectively, the chassis is provided with at least one through hole adapted to the connecting post, and the connecting post penetrates through the corresponding through hole and is connected with the first sealing ring and the second sealing ring, respectively.

According to the installation structure of the conductive contact of the electronic cigarette, wherein the insulating part further comprises a connecting plate extending from the chassis, the connecting plate is provided with at least one first connecting hole, the electronic cigarette body is provided with at least one second connecting hole corresponding to the first connecting hole, and the connecting member sequentially passes through the first connecting hole and the second connecting hole to fasten the chassis to the electronic cigarette body.

According to the installation structure of the conductive contact of the electronic cigarette, wherein the conductive contact further comprises an elastic part received in the receiving groove, and the elastic part is positioned below the second contact with one end elastically abutting against the second contact and the other end elastically abutting against the inner wall of the receiving groove.

According to the installation structure of the conductive contact of the electronic cigarette, wherein the receiving groove is internally provided with a guiding groove adapted to the elastic part, and the elastic part is placed in the guiding groove with one end elastically abutting against the second contact and the other end elastically abutting against the bottom wall of the guiding groove.

According to the installation structure of the conductive contact of the electronic cigarette, wherein the elastic part is a conical spring, wherein the wide end of the elastic part elastically abuts against the bottom wall of the receiving groove, the narrow end of the elastic part elastically abuts against the second contact, and correspondingly, the end of the second contact abutting against the elastic part is provided with a contact plate adapted to the narrow end.

According to the installation structure of the conductive contact of the electronic cigarette, wherein the first contact comprises a contact body provided with the installation hole and a sleeve sleeved on the contact body, and the bottom end of the contact body elastically abuts against the sealing part.

An electronic cigarette comprises the installation structure of the conductive contact of the electronic cigarette as described in any one of the above.

The beneficial effect is that the invention discloses an installation structure of a conductive contact of an electronic cigarette and an electronic cigarette, wherein the installation structure of the conductive contact of the electronic cigarette comprises an electronic cigarette body provided with a receiving groove and a conductive contact which is installed in the receiving groove and is exposed to an opening of the receiving groove at one end thereof. The conductive contact comprises a first contact, a second contact, an insulating part and a sealing part provided with an installation hole, and the second contact is partially received in the installation hole; the insulating part is sleeved on the second contact and is partially received in the installation hole to separate the first contact from the second contact; the sealing part is partially sleeved on the insulating part and elastically abuts against the first contact, and the sealing part is partially sleeved on the second contact and elastically abuts against the insulating part. In this embodiment, the sealing part seals the gap between the insulating part and the first contact and the gap between the insulating part and the second contact to improve the oil-proof performance of the conductive contact.

BRIEF DESCRIPTION OF THE DRAWINGS

For a better illustration of the embodiments of the invention or the technical solution in the prior art, accompanying drawings needed in the description of the embodiments or the prior art are simply illustrated below. Obviously, the accompanying drawings described below are some embodiments of the invention. For those skilled in the art, other accompanying drawings may be obtained according to the structure shown in these accompanying drawings without creative work.

DESCRIPTION OF THE REFERENCE NUMBERS

Figure 1:
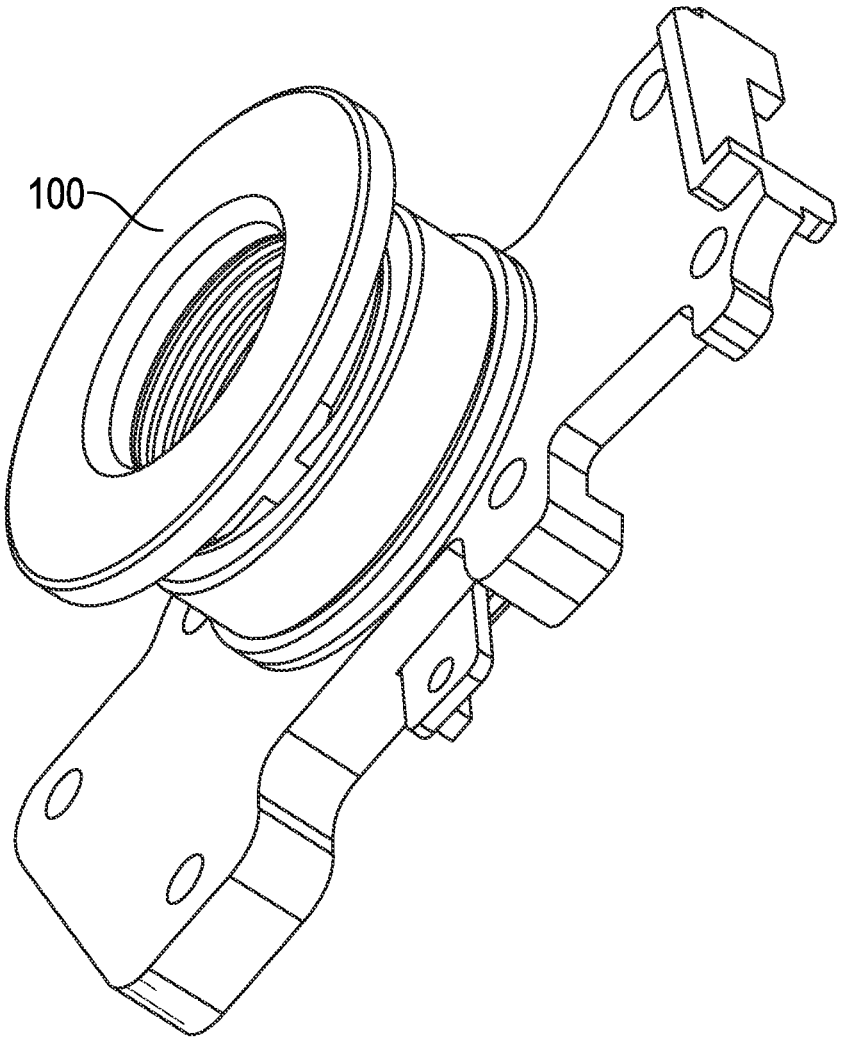
FIG. 1 is a schematic diagram illustrating the structure of a conductive contact of an electronic cigarette according to the invention.

| Reference number | Name of part | Reference number | Name of part |
|---|---|---|---|
| 100 | conductive contact | 200 | electronic cigarette body |
| 201 | receiving groove | 11 | contact body |
| 13 | installation hole | 13 | installation hole |
| 3 | sealing part | 21 | contact cap |
| 4 | insulating part | 22 | contact post |
| 2 | second contact | 23 | elastic part |
| 43 | Connecting plate | 41 | chassis |
| 31 | first sealing ring | 42 | upright post |
| 1 | first contact | 12 | sleeve |
| 32 | second sealing ring | 321 | collar |
| 3211 | flange | 3212 | positioning projection |
| 202 | guiding groove | 33 | connecting post |
| 421 | through hole | 431 | first connecting hole |
| 211 | first cylinder | 212 | second cylinder |
| 221 | step | 24 | contact plate |
| 25 | terminal | 2211 | positioning groove |
| 26 | groove | | |

The implementation of aims, the function features and the advantages of the invention are described below in further detail in conjunction with embodiments with reference to the drawings.

DESCRIPTION OF THE EMBODIMENTS

A clear and complete description as below is provided for the technical solution in the embodiments of the invention in conjunction with the drawings in the embodiments of the invention. Obviously, the embodiments described hereinafter are simply part embodiments of the invention, rather than all the embodiments. All other embodiments obtained by those skilled in the art based on the embodiments in the invention without creative work are intended to be included in the scope of protection of the invention.

It should be noted that all directional indications (such as top, bottom, left, right, front, behind . . . ) in the embodiments of the invention are merely to illustrate a relative position relation, a relative motion condition, etc. between each part in a certain state (for example, the state shown in the drawings). If the state changes, the directional indication changes accordingly.

In addition, if terms "first", "second", etc. appear in the invention, they are merely for the purpose of description, but cannot be understood as the indication or implication of relative importance or as the implicit indication of the number of the designated technical features; therefore, features defined by "first" and "second" may specifically or implicitly comprise at least one such feature. In addition, technical solutions of each embodiment of the invention may be combined mutually; however, this must be carried out on the basis that those skilled in the art can implement the combination. When the combination of technical solutions has a conflict or cannot be implemented, it should be considered that such combination of technical solutions does not exist and is not in the scope of protection claimed by the invention.

In the invention, unless otherwise specifically stated and defined, terms "connected", "fixed", etc. should be interpreted expansively. For example, "fixed" may be fixed connection, detachable connection, or integration; may be mechanical connection or electrical connection; direct connection, indirect connection through an intermediate, or internal communication between two elements or interaction of two elements, unless otherwise specifically defined. Those skilled in the art can understand the specific implication of the above terms in the invention according to specific conditions.

Figure 2:
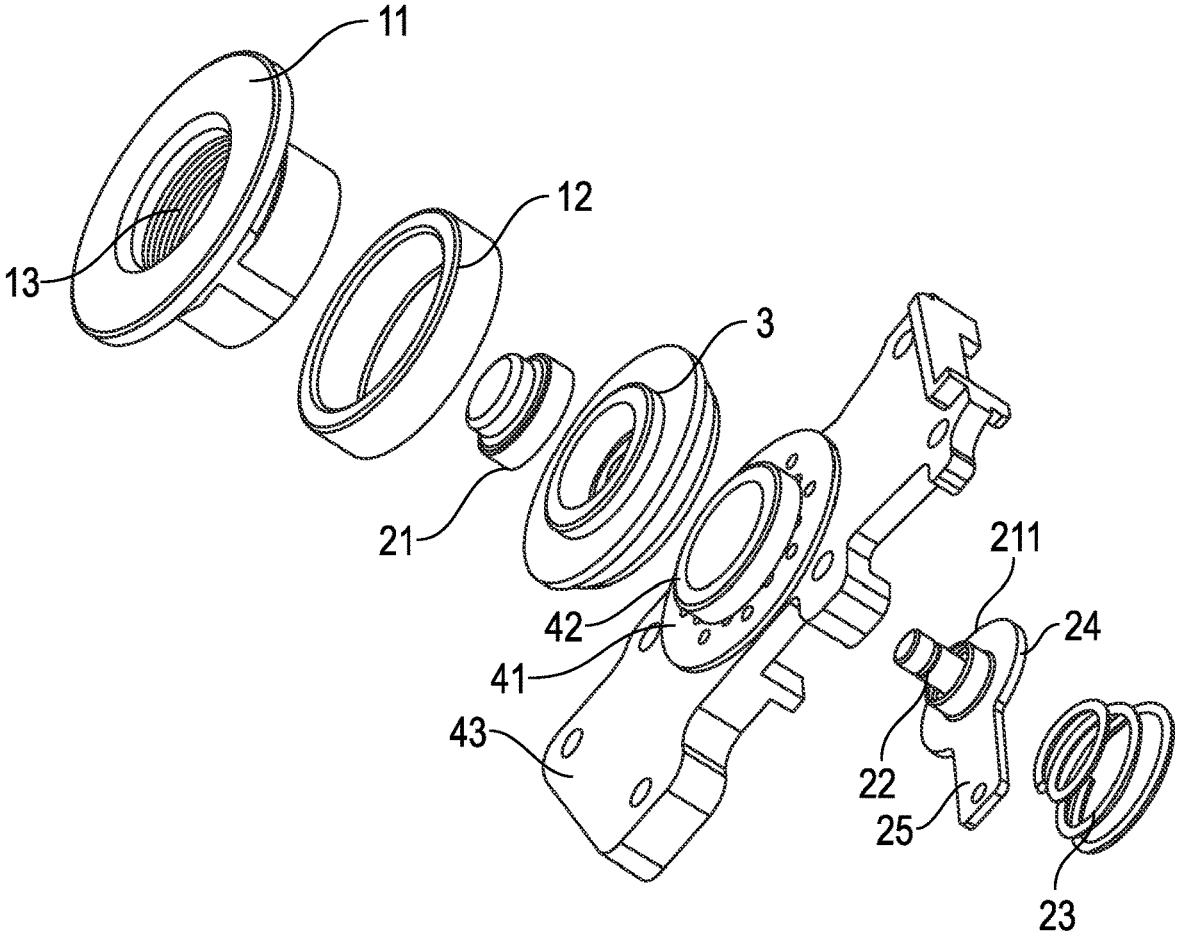
FIG. 2 is an explosion schematic diagram illustrating conductive contact of an electronic cigarette according to the invention.
Figure 3:
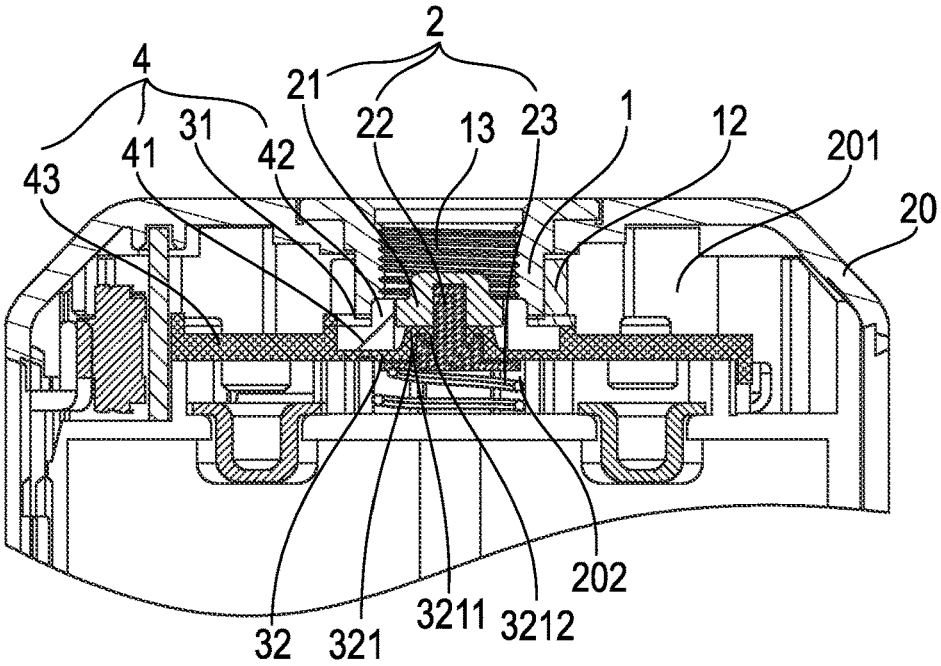
FIG. 3 is a sectional diagram illustrating an installation structure of a conductive contact of an electronic cigarette according to the invention.

The invention provides an installation structure of a conductive contact of an electronic cigarette, as shown in FIGS. 1-3, wherein the installation structure comprises an electronic cigarette body 200 provided with a receiving groove 201 and a conductive contact 100 which is installed in the receiving groove 201 and is exposed to an opening of the receiving groove 201 at one end thereof, wherein the conductive contact 100 comprises a first contact 1, a second contact 2, an insulating part 4 and a sealing part 3 provided with an installation hole 13, and the second contact 2 is partially received in the installation hole 13; the insulating part 4 is sleeved on the second contact 2 and is partially received in the installation hole 13 to separate the first contact 1 from the second contact 2; the sealing part 3 is partially sleeved on the insulating part 4 and elastically abuts against the first contact 1, and the sealing part is partially sleeved on the second contact 2 and elastically abuts against the insulating part 4. In this embodiment, the sealing part 3 seals the gap between the insulating part 4 and the first contact 1 and the gap between the insulating part 4 and the second contact 2 to improve the oil-proof performance of the conductive contact 100.

Figure 5:
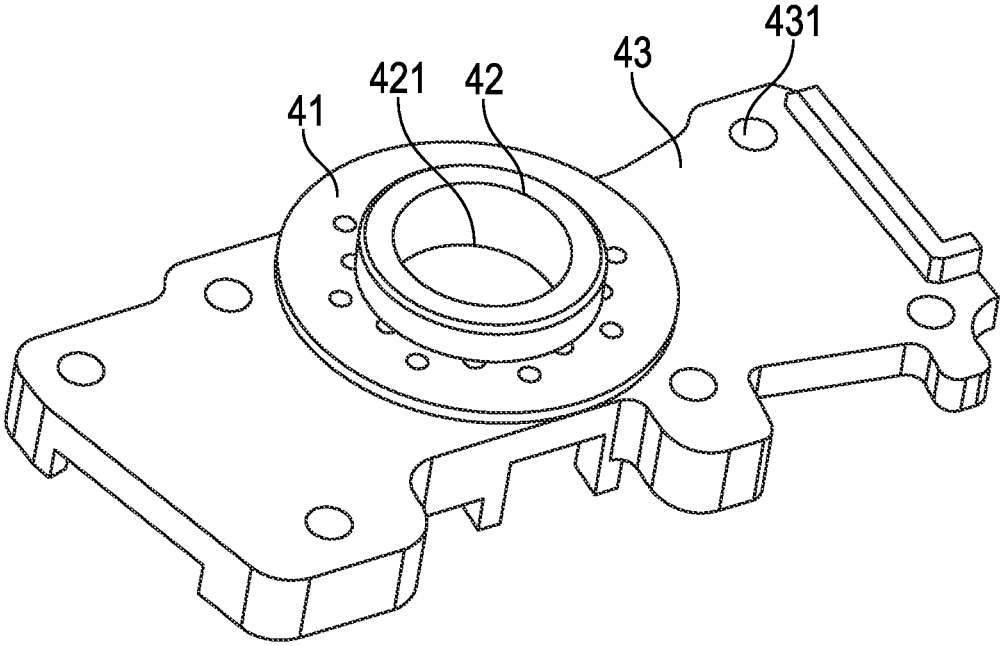
FIG. 5 is a schematic diagram illustrating the structure of an insulating part of a conductive contact of an electronic cigarette according to the invention.

In this embodiment, as shown in FIG. 2 and FIG. 5, the insulating part 4 comprises an upright post 42 provided with a through hole 421 and a chassis 41 sleeved on the periphery of the upright post 42, the upright post 42 is sleeved on the second contact 2 through the through hole 421, and the periphery of the upright post 42 is partially received in the installation hole 13. Preferably, the periphery of the upright post 42 is in interference fit with the installation hole 13. The first contact 1 and the second contact 2 are spaced apart by the upright post 42 so that they are not in contact with each other. In this way, when the first contact 1 and the second contact 2 are electrically connected to the positive and negative poles of the body of the electronic cigarette, no short circuit will occur. Further, the inside of the installation hole 13 is also concavely provided with an annular slot adapted to the upright post 42. The top surface of the upright post 42 partially abuts against an inner wall of the annular slot to play a limiting role. The side surface of the upright post 42 abuts against the other inner wall of the annular slot. Further, the chassis 41 is fastened to the electronic cigarette body 200 and is located between the bottom end of the receiving groove 201 and the bottom end of the first contact 1 and has gaps with the bottom end of the receiving groove 201 and the bottom end of the first contact 1, respectively. The bottom end of the first contact 1 is an end far away from the opening of the receiving groove 201.

Figure 4:
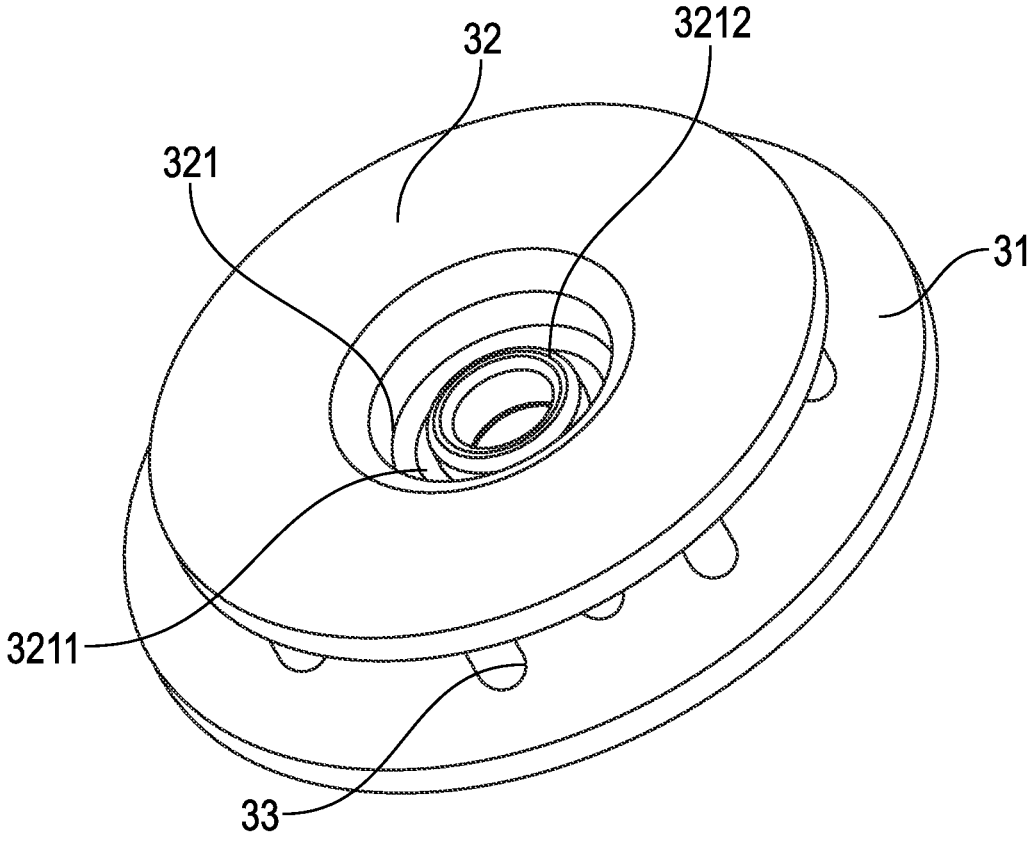
FIG. 4 is a schematic diagram illustrating the structure of a sealing part of a conductive contact of an electronic cigarette according to the invention.

In this embodiment, as shown in FIG. 2, FIG. 3, and FIG. 4, the sealing part 3 comprises a first sealing ring 31 and a second sealing ring 32 which are arranged in parallel and are concentric with each other. The first sealing ring 31 is located directly above the second sealing ring 32 (i.e., the first sealing ring 31 is close to the opening). The first sealing ring 31 is sleeved on the upright post 42 and is clamped between the chassis 41 and the bottom end of the first contact 1. The first sealing ring 31 seals the gap between the chassis 41 and the first contact 1, so as to prevent oil from leaking from the inner wall of the first contact 1 to the inner wall of the receiving groove 201 through the gap and corroding other components in the receiving groove 201.

Further, one end of the second sealing ring 32 is sleeved on the second contact 2 and elastically abuts against the second contact 2, while the other end thereof is clamped between the chassis 41 and the bottom end of the receiving groove 201 to seal the gap between the second contact 2 and the insulating part 4. At the same time, one end elastically abuts against the second contact 2, and the other end is clamped between the chassis 41 and the bottom end of the receiving groove 201, so that one end of the second sealing ring clamped between the chassis 41 and the receiving groove 201 may be used as a fixed end, providing a fulcrum for elastic deformation and up-down oscillation of the other end.

Further, as shown in FIG. 3, in order to improve the sealing effect of the second sealing ring 32, one end of the second sealing ring 32 sleeved on the second contact 2 is convexly provided with a collar 321 in the axial direction. The collar 321 is sleeved on the second contact 2, and the inner wall of the collar 321 elastically abuts against the periphery of the second contact 2, increasing the contact area between the sealing part 3 and the second contact 2 to prevent oil from leaking down the outer surface of the second contact 2. Further, the collar 321 is convexly provided with a flange 3211 toward the second contact 2. That is, the inner wall of the collar 321 is provided with a flange 3211 toward the center of a circle. The end of the flange 3211 far away from the collar 321 elastically abuts against the second contact 2. That is, the through hole 421 encircled by the flange 3211 is in interference fit with the second contact 2. The flange 3211 may be rectangular, square, polygonal, or arc-shaped. In one embodiment of the invention, the flange 3211 is in the shape of a circular arc, and the circular arc parabolic structure helps the flange 3211 to form a closer contact with the second contact 2 and improve the oil-proof effect.

Further, in order to improve the bonding strength between the sealing part 3 and the second contact 2 and prevent one of the sealing part 3 and the second contact 2 from being separated from the other due to displacement of one of the sealing part 3 and the second contact 2 during use, the periphery of the second contact 2 may be convexly provided with a groove adapted to the flange 3211. For example, in one embodiment of the invention, the flange 3211 is in the shape of a circular arc, and then the groove is also in the shape of a circular arc. In this way, the flange 3211 may be completely placed in the groove, so that the second sealing ring 32 is inserted into the second contact 2. On the one hand, the bonding strength between the second sealing ring 32 and the second contact 2 can be enhanced, and on the other hand, even if tobacco tar leaks from the gap between the second sealing ring 32 and the second contact 2, the leaked tobacco tar can be received through the flange 3211, and the tobacco tar can flow into the sealing layer encircled by the second sealing ring 32 to prevent the tobacco tar from continuing to leak downwards, thereby achieving the purpose of oil prevention. Preferably, the flange 3211 is in interference fit with the groove to prevent the flange 3211 from coming out of the groove.

Figure 6:
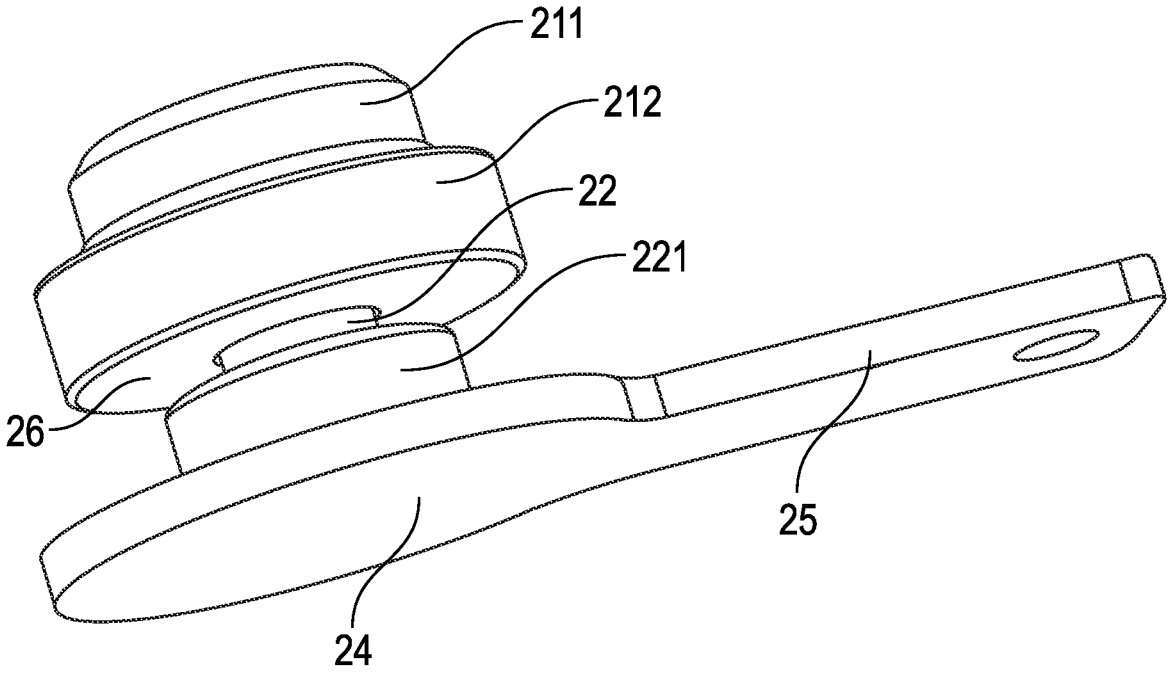
FIG. 6 is a schematic diagram illustrating the structure of a second contact of a conductive contact of an electronic cigarette according to the invention.

In this embodiment, as shown in FIG. 2 and FIG. 6, the second contact 2 comprises a contact cap 21 and a contact post 22. One end of the contact cap 21 extends out of the through hole 421 and is exposed in the installation hole 13 for electrical contact of an external load, and the other end thereof is received in the through hole 421 and is sleeved on the periphery of the contact post 22. The contact cap 21 has a circular boss structure and comprises a first cylinder 211 and a second cylinder 212. The first cylinder 211 is placed on the second cylinder 212, and the diameter of the first cylinder 211 is smaller than the diameter of the second cylinder 212. The side of the second cylinder 212 far away from the first cylinder 211 is provided with a receiving hole (not shown) and is sleeved on the periphery of the contact post 22 through the receiving hole. The contact post 22 is provided with a step 221. The side of the second cylinder 212 provided with the receiving hole encloses the groove 26 with the step 221 and the contact post 22. When the flange 3211 is placed in the groove 26, the flange 3211 is clamped between the second cylinder 212 and the step 221 to play a role in fastening the flange 3211.

Further, as shown in FIG. 3, the conductive contact 100 further comprises an elastic part 23 received in the receiving groove 201, and the elastic part 23 is positioned below the contact post 22 with one end elastically abutting against the contact post 22 and the other end elastically abutting against the inner wall of the receiving groove 201. That is, the bottom end of the second contact 2 is only supported by the resilient force from the elastic part 23, and moves up and down under the action of the elastic part 23 in the process of pressing/releasing the contact cap 21, thereby ensuring reliable electrical contact with the external load.

In this embodiment, the elastic part 23 is a spring. Preferably, the elastic part 23 is a conical spring, wherein the wide end of the elastic part 23 elastically abuts against the bottom wall of the receiving groove 201, and the narrow end of the elastic part 23 elastically abuts against the second contact 2, This helps the elastic part 23 to reduce the deviation in the radial direction during compression/resilience, thereby ensuring that the second contact 2 can move up and down in the axial direction. Further, the end of the contact post 22 abutting against the elastic part 23 may be further provided with a contact plate 24 adapted to the narrow end. Preferably, the diameter of the contact plate 24 is slightly larger than the diameter of the narrow end. Further, a terminal 25 may also extend from one end of the contact plate 24, and the contact plate 24 is electrically connected to the battery component of the electronic cigarette body 200 through the terminal 25.

Further, in order to ensure that the elastic part 23 is compressed/rebounded only in the axial direction without deviation, the receiving groove 201 is internally provided with a guiding groove 202 adapted to the elastic part 23, and the elastic part 23 is placed in the guiding groove 202 with one end elastically abutting against the second contact 2 and the other end elastically abutting against the bottom wall of the guiding groove 202.

In this embodiment, as shown in FIG. 2 and FIG. 3, since the second contact 2 moves up and down in the axial direction under the action of the elastic part 23, in order to ensure that the second contact 2 is not separate from the second sealing ring 32 during the up and down movement and thus the sealing is not disabled, the inner wall of the groove 26 is provided with at least one positioning groove 2211, the flange 3211 is provided with at least one positioning projection 3212 adapted to the positioning groove 2211, and the positioning projection 3212 is placed in the positioning groove 2211 at a corresponding position to lock the relative position between the second contact 2 and the second sealing ring 32. Further, since the groove 26 is encircled by the side of the second cylinder 212 provided with the receiving hole, the step 221, and the contact post 22, the positioning groove 2211 may be provided on any of the second cylinder 212, the step 221, or the contact post 22. Preferably, the positioning groove 2211 is provided on the step 221, and the positioning groove 2211 is in interference fit with the positioning projection 3212 on the flange 3211 to prevent the second sealing ring 32 from coming out of the second contact 2.

In this embodiment, the first sealing ring 31 and the second sealing ring 32 are placed in the gap between the insulating part 4 and the first contact 1 and the gap between the insulating part 4 and the bottom wall of the receiving groove 201, respectively, and both elastically abut against the insulating part 4. In other words, the insulating part 4 is clamped between the first sealing ring 31 and the second sealing ring 32. In order to facilitate the assembly of the insulating part 4 and the sealing part 3 and improve the sealing performance of the sealing part 3, the insulating part 4 and the sealing part 3 may be made into an integrated structure in an integrated manner in practical applications. For example, the insulating part 4 and the sealing part 3 may be made into an integrated structure in a manner of double-shot molding. The sealing part 3 may be made of a soft rubber material, for example, silica gel, TPE|TPR (thermoplastic elastomer) soft rubber, PVC soft rubber, etc. The insulating part 4 is made of a hard rubber material, for example, ABS plastic and other engineering plastics.

Further, as shown in FIG. 4, in order to prevent the sealing part 3 from coming out of the insulating part 4 and increasing the bonding force there between, the sealing part 3 further comprises at least one connecting post 33, both ends of the connecting post 33 are vertically connected with the first sealing ring 31 and the second sealing ring 32, respectively. Correspondingly, the chassis 41 is provided with at least one through hole adapted to the connecting post 33, and each of the connecting posts 33 penetrates through the corresponding through hole and is connected with the first sealing ring 31 and the second sealing ring 32, respectively, so that the bonding strength between the sealing part 3 and the insulating part 4 can be effectively improved.

In this embodiment, as shown in FIG. 3 and FIG. 5, the insulating part 4 further comprises a connecting plate 43 extending from the chassis 41, the connecting plate 43 is provided with at least one first connecting hole 431, the electronic cigarette body 200 is provided with at least one second connecting hole corresponding to the first connecting hole 431. The connecting member sequentially passes through the first connecting hole 431 and the second connecting hole to fasten the connecting plate 43 to the electronic cigarette body 200, thereby fastening the insulating part 4 to the electronic cigarette body 200.

In this embodiment, as shown in FIG. 2, the first contact 1 comprises a contact body 11 and a sleeve 12. The contact body 11 is provided with the installation hole 13, and the sleeve 12 is sleeved on the periphery of the contact body 11. The inner wall of the installation hole 13 is provided with an internal thread through which an external load is installed. The bottom end of the contact body 11 elastically abuts against the first sealing ring 31 to prevent oil leakage from the first contact 1. In practical applications, a lead wire may be welded to the sleeve 12 or the contact body 11, which is electrically connected to the battery component in the electronic cigarette body 200 through the lead wire. Of course, a conductive sheet may be also sleeved on the periphery of the contact body 11, which is connected to the lead wire through the conductive sheet.

The invention further provides an electronic cigarette, which comprises the installation structure of the conductive contact of the electronic cigarette as described above. Refer to the above embodiment for the specific structure of the installation structure of the conductive contact of the electronic cigarette. Due to the use of all the technical solutions of all the above embodiments, the electronic cigarette has at least all the beneficial effects brought by the technical solutions of the above embodiments, which will not be described in detail herein.

The above are preferred embodiments of the invention merely and are not intended to limit the patent scope of the invention. Any equivalent structures made according to the description and the accompanying drawings of the invention without departing from the idea of the invention, or any equivalent structures applied in other relevant technical fields directly or indirectly are intended to be included in the patent protection scope of the invention.

What is claimed is:

1. An installation structure of a conductive contact of an electronic cigarette, wherein the installation structure comprises an electronic cigarette body provided with a receiving groove and a conductive contact which is installed in the receiving groove and is exposed to an opening of the receiving groove at one end thereof, wherein the conductive contact comprises a first contact, a second contact, an insulating part and a sealing part provided with an installation hole, and the second contact is partially received in the installation hole; the insulating part is sleeved on the second contact and is partially received in the installation hole to separate the first contact from the second contact; the sealing part is partially sleeved on the insulating part and elastically abuts against the first contact, and the sealing part is partially sleeved on the second contact and elastically abuts against the insulating part.

2. The installation structure of the conductive contact of the electronic cigarette according to claim 1, wherein the insulating part comprises an upright post provided with a through hole and a chassis sleeved on the periphery of the upright post, the upright post is sleeved on the second contact and is received in the installation hole, and abuts against the inner wall of the installation hole to separate the first contact from the second contact; the chassis is fastened to the electronic cigarette body and is located between the bottom end of the receiving groove and the first contact, a gap is formed between the chassis and the bottom end of the receiving groove, and a gap is formed between the chassis and the first contact.

3. The installation structure of the conductive contact of the electronic cigarette according to claim 2, wherein the sealing part comprises a first sealing ring and a second sealing ring, the first sealing ring is sleeved on the upright post and is clamped between the chassis and the first contact to seal the gap between the insulating part and the first contact; and the second sealing ring is sleeved on the second contact and is clamped between the chassis and the bottom end of the receiving groove to seal the gap between the second contact and the insulating part.

4. The installation structure of the conductive contact of the electronic cigarette according to claim 3, wherein one end of the second sealing ring sleeved on the second contact is convexly provided with a collar in the axial direction, the collar is sleeved on the second contact and is convexly provided with a flange in the direction of the second contact, and the flange elastically abuts against the periphery of the second contact.

5. The installation structure of the conductive contact of the electronic cigarette according to claim 4, wherein the second contact is concavely provided with a groove adapted to the flange, and the flange is placed in the groove and is in interference fit with the groove.

6. The installation structure of the conductive contact of the electronic cigarette according to claim 5, wherein the inner wall of the groove is provided with at least one positioning groove, the flange is provided with at least one positioning projection adapted to the positioning groove, and the positioning projection is placed in the positioning groove at a corresponding position.

7. The installation structure of the conductive contact of the electronic cigarette according to claim 5, wherein the second contact comprises a contact cap and a contact post provided with a step, one end of the contact cap extends out of the through hole and is exposed in the installation hole for electrical contact of an external load, and the other end thereof is received in the through hole and is sleeved on the periphery of the contact post, and the other end of the contact cap encloses the groove with the step; and the cooperation between the flange and the groove causes the second sealing ring to be clamped between the contact cap and the contact post.

8. The installation structure of the conductive contact of the electronic cigarette according to claim 3, wherein the sealing part further comprises at least one connecting post, both ends of the connecting post are vertically connected with the first sealing ring and the second sealing ring, respectively, the chassis is provided with at least one through hole adapted to the connecting post, and the connecting post penetrates through the corresponding through hole and is connected with the first sealing ring and the second sealing ring, respectively.

9. The installation structure of the conductive contact of the electronic cigarette according to claim 2, wherein the insulating part further comprises a connecting plate extending from the chassis, the connecting plate is provided with at least one first connecting hole, the electronic cigarette body is provided with at least one second connecting hole corresponding to the first connecting hole, and the connecting member sequentially passes through the first connecting hole and the second connecting hole to fasten the chassis to the electronic cigarette body.

10. The installation structure of the conductive contact of the electronic cigarette according to claim 1, wherein the conductive contact further comprises an elastic part received in the receiving groove, and the elastic part is positioned below the second contact with one end elastically abutting against the second contact and the other end elastically abutting against the inner wall of the receiving groove.

11. The installation structure of the conductive contact of the electronic cigarette according to claim 10, wherein the receiving groove is internally provided with a guiding groove adapted to the elastic part, and the elastic part is placed in the guiding groove with one end elastically abutting against the second contact and the other end elastically abutting against the bottom wall of the guiding groove.

12. The installation structure of the conductive contact of the electronic cigarette according to claim 10, wherein the elastic part is a conical spring, wherein the wide end of the elastic part elastically abuts against the bottom wall of the receiving groove, the narrow end of the elastic part elastically abuts against the second contact, and correspondingly, the end of the second contact abutting against the elastic part is provided with a contact plate adapted to the narrow end.

13. The installation structure of the conductive contact of the electronic cigarette according to claim 1, wherein the first contact comprises a contact body provided with the installation hole and a sleeve sleeved on the contact body, and the bottom end of the contact body elastically abuts against the sealing part.

14. An electronic cigarette, wherein the electronic cigarette comprises the installation structure of the conductive contact of the electronic cigarette according to claim 1.

* * * * *